US008541350B2

(12) United States Patent
Kirsch et al.

(10) Patent No.: US 8,541,350 B2
(45) Date of Patent: Sep. 24, 2013

(54) DRY-FILM, ANTI-CORROSIVE COLD FORMING LUBRICANT

(75) Inventors: Gabriel J. Kirsch, Clinton Township, MI (US); Paul B. Kutzko, Livonia, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 35 days.

(21) Appl. No.: 12/779,464

(22) Filed: May 13, 2010

(65) Prior Publication Data

US 2010/0285323 A1 Nov. 11, 2010

Related U.S. Application Data

(63) Continuation of application No. PCT/US2008/012861, filed on Nov. 17, 2008.

(60) Provisional application No. 60/988,617, filed on Nov. 16, 2007.

(51) Int. Cl.
*C01G 39/06* (2006.01)
*C10M 137/10* (2006.01)
*C10M 169/04* (2006.01)

(52) U.S. Cl.
USPC ..... 508/433; 508/167

(58) Field of Classification Search
USPC ..... 508/167, 433
See application file for complete search history.

(56) References Cited

U.S. PATENT DOCUMENTS

| | | | | |
|---|---|---|---|---|
| RE23,184 | E | 12/1949 | Whitbeck | |
| 2,588,234 | A | 3/1952 | Henricks | |
| 2,868,671 | A | 1/1959 | Henricks | |
| 2,957,825 | A | 10/1960 | Henricks | |
| 3,249,538 | A | 5/1966 | Freier | |
| 3,556,996 | A | 1/1971 | Jones et al. | |
| 3,869,317 | A | 3/1975 | Marx | |
| 3,974,674 | A | 8/1976 | Orozco et al. | |
| 4,052,323 | A | 10/1977 | Feneberger et al. | |
| 4,138,348 | A | 2/1979 | Grasshoff | |
| 4,160,370 | A * | 7/1979 | Hacias | 72/42 |
| 4,169,916 | A | 10/1979 | Tsutsui et al. | |
| 4,257,902 | A | 3/1981 | Singer | |
| 4,289,546 | A | 9/1981 | Hacias | |
| 4,289,547 | A | 9/1981 | King et al. | |
| 4,313,836 | A * | 2/1982 | Nassry et al. | 508/276 |
| 4,377,487 | A | 3/1983 | Freeman | |
| 4,497,667 | A | 2/1985 | Vashi | |
| RE33,124 | E * | 12/1989 | Singer | 508/219 |
| 5,039,435 | A | 8/1991 | Hanano | |
| 5,154,839 | A | 10/1992 | Hanano | |
| 5,277,831 | A | 1/1994 | Hanano | |
| 5,279,749 | A | 1/1994 | Hanano | |
| 5,279,750 | A | 1/1994 | Hanano | |
| 5,307,660 | A | 5/1994 | Stoutenburg | |
| 5,468,402 | A | 11/1995 | Hachiya et al. | |
| 5,476,601 | A | 12/1995 | Bershas et al. | |
| 5,493,886 | A | 2/1996 | Graham | |
| 5,495,737 | A | 3/1996 | Graham | |
| 5,518,639 | A | 5/1996 | Luk | |
| 5,547,595 | A | 8/1996 | Hacias | |
| 5,584,201 | A | 12/1996 | Graham et al. | |
| 5,591,275 | A | 1/1997 | Miyafuji et al. | |
| 5,624,888 | A * | 4/1997 | Przybylski et al. | 508/161 |
| 5,624,889 | A | 4/1997 | Ozaki et al. | |
| 5,711,996 | A | 1/1998 | Claffey | |
| 5,837,658 | A | 11/1998 | Stork | |
| 6,025,306 | A | 2/2000 | Erdemir | |
| 6,241,830 | B1 | 6/2001 | Shimakura et al. | |
| 6,255,260 | B1 | 7/2001 | Stork | |
| 6,309,477 | B1 | 10/2001 | Shimakura et al. | |
| 6,335,309 | B1 | 1/2002 | Takagi et al. | |
| 6,376,433 | B1 | 4/2002 | Connor | |
| 6,455,476 | B1 | 9/2002 | Imai et al. | |
| 6,805,756 | B2 | 10/2004 | Claffey et al. | |
| 7,105,472 | B2 | 9/2006 | Zepf | |
| 2003/0221751 | A1 | 12/2003 | Claffey et al. | |
| 2004/0226629 | A1 | 11/2004 | Church | |
| 2005/0119133 | A1 * | 6/2005 | Komiyama et al. | 508/100 |

FOREIGN PATENT DOCUMENTS

| | | |
|---|---|---|
| EP | 0303734 A2 | 2/1989 |
| EP | 0334977 A1 | 10/1989 |
| EP | 0412788 A1 | 2/1991 |
| EP | 0613939 A2 | 9/1994 |
| EP | 0714975 A1 | 6/1996 |
| EP | 1350867 A1 | 10/2003 |
| GB | 1322838 A | 7/1973 |
| WO | 9614947 A1 | 5/1996 |

OTHER PUBLICATIONS

International Search Report, PCT/US2008/012861 mailed Feb. 27, 2009, 1 page.
European Search Report, EP 08849428.1-2014 mailed Apr. 11, 2012, 7 pages.

* cited by examiner

*Primary Examiner* — Prem C Singh
*Assistant Examiner* — Francis C Campanell
(74) *Attorney, Agent, or Firm* — Mary K. Cameron

(57) ABSTRACT

The invention provides a lubricant composition for generating a combined passivate and lubricating coating on a metal substrate with which the composition is brought into contact. The lubricant composition comprises an organic polymer and/or a wax dispersion; phosphates, preferably acid phosphate salts, and/or phosphoric acid; and optionally, a surfactant, a thickening aid, an anti-wear additive, a defoaming agent; a corrosion inhibitor; and/or a linear or branched hydrocarbon.

16 Claims, No Drawings

DRY-FILM, ANTI-CORROSIVE COLD FORMING LUBRICANT

CROSS-REFERENCE TO RELATED CASES

This application is a continuation under 35 U.S.C. Sections 365(c) and 120 of International Application No. PCT/US2008/012861, filed Nov. 17, 2008 and published on May 22, 2009 as WO 2009/064502, which claims priority from U.S. Provisional Application Ser. No. 60/988,617 filed Nov. 16, 2007, which are incorporated herein by reference in their entirety.

FIELD OF THE INVENTION

This invention relates to aqueous liquid combined passivate and lubricant coating compositions and to uses thereof. In particular, this invention relates to a highly effective lubricant composition that is preferably substantially or entirely free of dithiocarbamate, for use in the cold forming of metals, for example, iron, steel, and aluminum. These compositions, in a single contact with a metal substrate followed by drying into place on the metal substrate surface, produce a lubricious coating that combines both a solid adherent passivate coating and a solid and/or liquid lubricant and is highly effective in facilitating cold working of the thus-coated metal substrate in any type of cold working operation that requires deformation of the thus-coated surface of the object by relative motion between this coated substrate surface and a forming tool such as a die.

More particularly, this invention relates to a composition of the aforementioned type that forms a strongly-lubricating coating by a simple process in which, before a workpiece is to be subjected to cold forming, the composition is coated on the workpiece by spray or immersion at ambient temperature, and then dried. The invention also relates to processes for lubricated cold forming of metal, utilizing a lubricant composition according to the invention and blanks, meaning workpieces to be formed, that have been coated with the lubricant composition.

BACKGROUND OF THE INVENTION

Many aqueous liquid compositions that form coatings on metal surfaces that protect the metal surface while it is being cold worked are known. The previously most effective ones have generally been zinc, calcium, and/or sodium soaps applied over a preceding heavy phosphate conversion coating on steel substrates or over a complex calcium aluminate conversion coating on aluminum substrates. (Normally, a sodium stearate or other sodium soap salt is applied over a zinc phosphate coating or a calcium aluminate coating. Reaction between the sodium soap and the zinc or calcium in the previous conversion coating is believed to result in both zinc or calcium soap and sodium soap layers, and this type of lubricant is accordingly often called a "reactive" lubricant.) However, this combination is environmentally disadvantageous, especially when used over phosphate coatings, because the liquid compositions used to form phosphate coatings generally contain some types of metal ions, such as those of zinc, nickel, manganese, and/or the like, that are regarded as polluting. Zinc and calcium soaps are substantially insoluble in water, but cause workplace nuisances at best and hazards at worst because they tend to form fine dust particles in the air around sites of cold working processes when used as cold working lubricants. This combination is also economically disadvantageous because it normally requires separate conversion coating and lubricant coating process steps, with associated requirements for equipment for large scale practice of cold working using this method of lubricating the metal substrates being worked.

Various polymer based lubricants have been taught in the art as replacements for the combination of stearates over zinc phosphate conversion coatings, but heretofore none of the polymer based lubricants have proved to be commercially acceptable in all applications. A frequently objectionable feature of commercial use of prior polymeric lubricants is the presence of scratches on the surface of the cold worked article.

Previous attempts to combine the best features of conversion coatings and other lubricants in a single step resulted in the issuance of U.S. Pat. Nos. 4,289,546 and 4,289,547, which have many disclosures in common, and in earlier patents cited in these two patents. In long term practice, the teachings of all of these patents proved to be commercially unacceptable for use on steel, which is the most common substrate treated for protection during cold working, because iron cations dissolved from the steel eventually accumulated in the working compositions to such an extent as to make their continued use unsatisfactory.

More recently, U.S. Published Patent Application No. 2004-0226629A1 disclosed a composition for forming a combined conversion and lubricating coating on a metal substrate comprising an oxyethylated aliphatic alcohol whose aliphatic hydrocarbon moiety contains 18 or more carbon atoms and dissolved phosphate anions. The conversion and lubricating coating is generated in a heated phosphating bath. One drawback of this composition and process was sludging in the bath, due to dissolution of iron during formation of the conversion coating. The iron in the bath generated iron phosphate particles. During use, the concentration of particles eventually reached a concentration where the particles were incorporated into the lubricating coating, which resulted in galling and scratching of workpieces.

Applicants herein have overcome the drawbacks of these prior art conversion coating/lubricant baths by delaying most of the passivating reaction of the metal substrate with the coating composition until after the substrate has been removed from the coating bath.

A major object of this invention is to provide lubricants and processes that will eliminate or at least reduce the environmental and other disutilities noted above while still achieving cold working performance that is adequate when compared with the prior art use of phosphate conversion coatings followed by zinc soap application and to other single step lubricants commonly used in cold forming. Other alternative or concurrent objects are to reduce total energy and/or other costs of cold forming operations, particularly by reducing process related waste of objects being cold worked, more particularly because of rejection for scratched surfaces, and/or by achieving reduced press tonnages required for forming operations. Still another alternative or concurrent object is to provide a lubricant satisfactory for extruding under the more severe conditions in current commercial practice.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its grammatical variations may be applied to elemental, ionic, and any other chemical species defined by number and type of atoms present, as well as to compounds with well defined molecules.

SUMMARY OF THE INVENTION

It is an object of the invention to provide a lubricant composition that is preferably substantially or entirely free of dithiocarbamate and comprises water, phosphates and/or phosphoric acid; an organic polymer and/or a wax dispersion; and optionally anti-wear additives, thickening aids, surfactant and defoaming agents. This composition may be a working bath or concentrates that form a working bath by dilution with water.

It is a further object of the invention to provide an aqueous liquid composition comprising:

A) At least one organic polymer and/or a wax dispersion;

B) At least one phosphate salt and/or phosphoric acid;

C) optionally, at least one surfactant;

D) optionally at least one thickening aid;

E) optionally, at least one anti-wear additive;

F) optionally, at least one defoaming agent;

G) optionally, at least one corrosion inhibitor; and

H) optionally, at least one liquid linear or branched hydrocarbon different from A);

wherein the weight ratio of (A) to (B) ranges from about 10 to about 0.1.

It is a further object of the invention to provide an aqueous liquid composition aqueous liquid lubricant composition, wherein:

A) comprises 2-15 wt % on a dry solids basis of a polyethylene dispersion,

B) comprises 2-20 wt % of acid phosphate salts;

C) comprises 0.1-1.0 wt % of a surfactant

D) comprises 0.5-1.0 wt % cellulosic thickener

E) comprises 0.0-4.0 wt % graphite and/or 0.0-2.0 wt % MoS2

F) comprises 0.0-1.0 wt % defoamer.

It is a further object of the invention to provide an aqueous liquid composition wherein (H) comprises 1.0-10.0 wt % of a liquid aliphatic hydrocarbon.

It is a further object of the invention to provide an aqueous liquid composition wherein (B) comprises at least one of monoammonium phosphate and monosodium phosphate.

It is a further object of the invention to provide an aqueous liquid composition comprising a surfactant in an amount effective to promote uniform application of the composition to the substrate.

It is another object of the invention to provide a dry film lubricant on a metal workpiece said dry film lubricant comprising reaction products of the metal workpiece and a lubricant composition as described above.

It is another object of the invention to provide a blank comprising a metal workpiece having a coating of: a) a lubricant composition as described above that has been dried; and/or b) reaction products of at least one substance selected from components of said lubricant composition and the workpiece.

It is another object of the invention to provide a process for creating a lubricious coating comprising:

contacting a blank metal workpiece with a lubricant composition that does not form a conversion coating on the workpiece at ambient temperature;

drying or working the coated metal workpiece, whereby the coated metal workpiece is heated such that components of the lubricant composition react with metal surfaces of the workpiece to thereby form a passivating phosphate coating and a dry film lubricant.

It is a further object of the invention to provide a method of forming a combined passivate and lubricating coating on a metal substrate with which the composition has been brought into contact, the method comprising coating the metal substrate with the composition according to the invention at ambient temperature and drying the composition on the metal substrate such that a passivate coating forms on the metal substrate during drying. The method may comprise heating the composition at a temperature between about 170 to 250 degrees F. to accelerate the drying of the composition and to promote chemical reaction among non-volatile components and the metal substrate.

It is another object of the invention to provide a formed metal workpiece having a passivate film thereon, and a process of making same, said passivate film being made by:

A) coating a blank metal workpiece with a lubricant composition that is substantially or entirely free of dithiocarbamate and comprises water, phosphates and/or phosphoric acid; an organic polymer and or a wax dispersion; and optionally anti-wear additives, thickening aids, surfactant and defoaming agents at ambient temperature (40 to 100 degrees Fahrenheit);

B) drying the lubricant composition on the blank metal workpiece to form a dry film lubricant thereon;

C) forming the blank metal workpiece thereby generating a formed metal workpiece having a passivate film thereon.

It is another object of the invention to provide a formed metal workpiece having a passivate film thereon, and a process of making same, wherein the passivate film is generated either by heating the workpiece after step A) or by the forming step C).

DETAILED DESCRIPTION OF THE INVENTION

Applicants have discovered a liquid coating composition for forming a lubricious coating that, when applied prior to cold forming, leaves a passivating film on the surface of the formed article, which film is generated substantially completely after removal from the coating bath. In this context, "generated substantially completely" means at least, in increasing order of preference, 50, 60, 70, 80, 90, 95, 98 or 100 wt % of the passivate film is generated after removal of the workpiece from the coating bath.

This lubricious coating is produced when a metal workpiece is it immersed in an aqueous solution or aqueous dispersion of a lubricant composition that, is preferably substantially or entirely free of dithiocarbamate and, comprises water, phosphates and/or phosphoric acid; an organic polymer and/or a wax dispersion; and is thereafter dried. The Applicants also discovered that a particularly excellent lubricating performance can be imparted to the obtained coating when the aqueous solution or dispersion also contains anti-wear additives, such as graphite and/or $MoS_2$.

Embodiments of the invention include liquid working compositions that are suitable for directly treating metal surfaces, dried solid lubricating coatings formed by drying such working compositions and metal workpieces bearing such solid lubricating coatings, both before and after forming, concentrate compositions from which working compositions can be formed by dilution with water and/or by mixing with other concentrate compositions, lubricated metal plastic working processes lubricated by a dried composition according to the invention, and processes for preparing metal objects for plastic cold working by providing them with a solid lubricating coating by drying onto the metal objects a liquid coating of a working liquid composition according to the invention.

An aqueous lubricant composition according to the invention comprises:

A) an organic polymer and/or a wax dispersion;

B) phosphates, preferably acid phosphate salts, and/or phosphoric acid;

C) optionally, a surfactant;

D) optionally a thickening aid;

E) optionally, an anti-wear additive;

F) optionally, a defoaming agent;

G) optionally, a corrosion inhibitor; and

H) optionally, a linear or branched hydrocarbon.

In one embodiment, the aqueous lubricant composition comprises:

2-15 wt % on a dry solids basis of a polyethylene dispersion, 2-20 wt % of acid phosphate salts in total, said total comprising one or both of 0-10 wt % monoammonium phosphate;

0-10 wt % monosodium phosphate;

0.1-1.0 wt % of a $C_{9-11}$ surfactant having an average of 4-8 moles of ethylene oxide 0.5-1.0 wt % cellulosic thickener 0.0-4.0 wt % graphite 0.0-2.0 wt % $MoS_2$ 0.0-1.0 wt % defoamer In another embodiment, the lubricant composition further comprises 0.1 to 2.0 wt % of a second surfactant, different from the $C_{9-11}$ surfactant, preferably another alkoxylated alcohol, most preferably a $C_{12-15}$, surfactant with an average of 2-6 moles of ethylene oxide. In another embodiment, the lubricant composition further comprises 1.0-10.0 wt % of a liquid aliphatic hydrocarbon.

Organic polymers (A) suitable for use in the lubricant composition of the invention are polyethylene dispersions, polyvinyl alcohols, polyvinylpyrrolidones, acrylic polymers, vinyl acetate polymers, epoxy polymers, urethane polymers, and phenolic polymers. Suitable polymers are stable against oxidation during cold forming operations. Polyethylene dispersions are preferred, as are other organic polymers free from oxidatively labile groups such as ketones, aldehydes, carboxyl groups, ether linkages, ester linkages, and non-aromatic unsaturation. The polymers can be either water-soluble or water-dispersible. Desirably the amount of polymer present in a working bath, on a dry solids basis, is at least in increasing order of preference 2, 3, 4, 5, 6, 7 wt % and is at least for economy, not more than 12, 13, 14, 15, 18, 20, 25 wt %. In a preferred embodiment the amount of polymer is about 4 wt % to about 12 wt %. Preferably the polymer is a solid at ambient temperature and desirably has a melting point of at least in increasing order of preference 100, 110, 115, 120, 125, 130 degrees Centigrade.

The phosphates (B) of the lubricant composition may be sourced from any phosphoric acid salt of a mono- or di-valent metal provided that the resulting salt is sufficiently soluble in the working bath and does not detrimentally affect performance of the composition. Acid phosphate salts of alkali metals and alkaline earth metals are preferred, but transition metal acid salts that meet the afore-mentioned requirements are also suitable. In an alternative embodiment, no transition metal acid salts are used. In one embodiment, ammonium acid salts of phosphates are used alone or in combination, such as monoammonium phosphate and monosodium phosphate.

Alternatively, the phosphoric acid salts may be generated in situ by use of phosphoric acid in combination with one or more sources of a cation for the phosphoric acid salt. Desirably, substances acting as sources of the metal cation for the phosphoric acid salt comprise anions that are not detrimental to the performance of the lubricant composition or are readily removed from the composition by, for example vaporization or precipitation. Examples of suitable sources of cation for the phosphoric acid salt include NaOH and $NH_4OH$.

The total amount of the phosphate salt in the aqueous lubricant composition is desirably in the range of from about 2.0 wt % up to the solubility limit of the particular phosphate salt. Desirably, the amount of phosphate salt in the aqueous lubricant composition is at least, in increasing order of preference 2, 3, 4, 5, 6, 7, 8, 9, 10 wt % and is not more than 35, 30, 20 wt %. At least for economy it is preferred that the total phosphate content in the as-dried lubricant coating be not more than 75 wt %, more preferably 50 wt %. In a preferred embodiment of the present invention, the phosphate is selected from the group consisting of ammonium dihydrogen phosphate and alkali metal acid phosphates, such as sodium dihydrogen phosphate, or mixtures thereof. In one embodiment, the mixture comprises 5-10 wt % ammonium dihydrogen phosphate and 2-5 wt % alkali metal acid phosphates.

Independently, the ratio of (A) to (B) is desirably 10, 9, 8, 7, 6, 5, 4, 3, 2, 1, 0.0, 0.8, 0.7, 0.6, 0.5, 0.4, 0.3, 0.2 or 0.1.

In some embodiments, the lubricant composition comprises at least one surfactant (C) present in an amount sufficient to stabilize the dispersion of any non-water soluble components in the lubricant composition. Suitable surfactants include non-ionic and/or ionic surfactants, one preferred example being alkoxylated aliphatic alcohols, which are desirably are water-soluble or water-dispersible. For purposes of this invention, alkoxylated alcohol will be understood by those of skill in the art to mean an alcohol that has been reacted with one or more moles of epoxide, such as by way of non-limiting example ethylene oxide, propylene oxide or butylene oxide, resulting in a polyether alcohol. Unless, otherwise specifically described herein, the terminal functional group of the alkoxylate is an alcohol functional group, i.e. —OH. The surfactant desirably comprises at least, in increasing order of preference, 2, 3, 4, 5 moles of alkoxylation and not more than in increasing order of preference 18, 12, 10 moles of alkoxylation. Ethylene oxide is preferred for the alkoxylate, but propylene oxide may be used to the extent that it does not interfere with the performance of the surfactant. Desirably the aliphatic portion of the alkoxylated aliphatic alcohol molecules has, in increasing order of preference, an average number of carbon atoms of at least 3, 5, 7, 9 and not more than in increasing order of preference, 18, 15, 13, 11 carbon atoms. Desirably the at least one surfactant comprises molecules corresponding to formula I:

$$(C_nH_{2n+1})O(C_2H_4O)_mH$$

where n=9, 10, 11, 12, 13, 14 or 15; and m=2, 3, 4, 5, 6, 7, 8, 9 or 10.

In a preferred embodiment, the at least one surfactant comprises molecules selected from alcohols corresponding to formula II:

$$(C_nH_{2n+1})O(C_2H_4O)_6H$$

where n=9, 10, 11.

In another embodiment, a combination of alkoxylated aliphatic alcohol surfactants is utilized where n=9, 10, 11, 12, 13, 14 or 15; and m=2, 3, 4, 5, 6, 7 or 8.

Optional components for the lubricant composition include anti-wear additives (D), such as by way of non-limiting example $MoS_2$ and graphite; thickening aids (E), as are known in the art, for example cellulosic thickeners. Other optional components include defoaming agents (F) and corrosion inhibitors (G) as are known in the art. Aqueous compositions containing ethoxylated alcohols sometimes stain or otherwise discolor metal surfaces exposed to them. If this is undesirable, it can generally be prevented by including in the working composition a suitable corrosion inhibitor as an optional component (G).

In some embodiments, the lubricant composition comprises a linear or branched hydrocarbon (H), having a viscosity range of 5-1000 centipoise and a melting point of less than 70 deg. C. Preferably, the melting point is such that the hydrocarbon is a liquid at ambient temperature. Suitable examples of such hydrocarbons are those having a flash point of greater 100 deg C. and include polyalphaolephins, polymers of unsaturated hydrocarbons and mineral oils.

In a working aqueous composition according to the invention, the concentration of component (H) preferably is at least, with increasing preference in the order given, 0.5, 1.0, 2.0, 2.5, 2.9, 3.3, 3.7, 4.1, 4.4, 4.6, or 4.8% of the composition. There is no known technical disadvantage when the concentration of component (H) is as much as 20 wt %, but for economy this concentration preferably and independently of the preferred minimum concentration is not more than, with increasing preference in the order given, 13, 11, 9.5, 8.5, 8.0, 7.6, or 7.3% of the composition. Independently, the ratio of (A) to (H) is desirably 15, 14, 13, 12, 11, 10, 9, 8, 7, 6, 5, 4, 3, 2, 1, 0.0, 0.8, 0.7, 0.6, 0.5, 0.4, 0.3, 0.2 or 0.1. If the concentration of component (H) is too low, the coating formed may not have adequate lubricity and plasticity required for severe cold forming operations.

The working bath has a pH of at least about 3.0 so as to limit the risk of etch and corrosion of the workpiece and not more than in increasing order of preference about 7.5, 7.0, 6.5, 6.0, 5.5, 5.0, 4.5, 4.0. In order to reach a pH value within the desired range, either acid or base may be added to the composition after most or all of its other ingredients have been mixed into it. If an acidifying agent is needed, phosphoric acid is generally preferred, provided that it can be added in sufficient amount to bring the pH to the desired range without exceeding the maximum preferred total phosphate anions concentration specified above. If an alkalinizing agent is needed, sodium hydroxide is usually preferred as the least expensive alternative that does not introduce any possibly troublesome constituents into the composition, but any suitable alkalinizing agent that does not interfere with the objects of the invention could be used.

The absolute concentrations of the various necessary, preferable, and optional ingredients in aqueous working or concentrate compositions according to the invention are not at all narrowly limited, and the preferences for concentrations of their predominant constituents are largely determined by the viscosity for both working and concentrate compositions. In a concentrate composition, the concentration of non-volatile ingredients preferably is as high as can be effectively utilized by the equipment available for removing the concentrate from its container and mixing the concentrate composition with water, and sometimes other materials, to form a working composition. In a working composition itself, the preferred viscosity is one that will form an at least temporarily adherent liquid film, on a substrate coated with the working composition, that when dried will contain the preferred amounts of non-volatile lubricant constituents. These preferred amounts vary widely with the exact choice of substrate and cold working conditions, but can readily be determined with minimal experimentation by those skilled in the art. The numerical preferences stated herein are believed to be correct for most uses but should be regarded only as general guidelines for exceptional uses.

Preferably, a lubricant composition according to the invention is substantially or entirely free of dithiocarbamate. By substantially free, it is meant that compositions of the invention contain less than, in increasing order of preference 0.50, 0.40, 0.30, 0.20, 0.10, 0.001, 0.0001 g/l of dithiocarbamate. It is preferred that no intentional addition of dithiocarbamate is made to compositions of the invention, although contaminant levels from drag-out or other sources are within the scope of the invention. Applicants found that this additive is unnecessary, adds expense to manufacturing and may be detrimental to performance of the composition.

For various reasons, almost always including at least a cost saving from elimination of an unnecessary ingredient, it is preferred that a composition according to this invention should be largely free from various materials often used in prior art compositions. In particular, compositions according to this invention in most instances preferably do not contain, with increasing preference in the order given, and with independent preference for each component named, more than 5, 4, 3, 2, 1, 0.5, 0.25, 0.12, 0.06, 0.03, 0.015, 0.007, 0.003, 0.001, 0.0005, 0.0002, or 0.0001% of each of (i) fatty oils of natural origin that have not been modified by chemical reaction from their naturally occurring form, (ii) zinc cations, (iii) calcium cations, (iv) magnesium cations, (v) hexavalent chromium, (vi) nickel cations, (vii) cobalt cations, (viii) copper cations, (ix) manganese in any ionic form, and (x) copolymers of styrene and maleic moieties. However, all the preferences stated in this paragraph are subordinated to the explicit descriptions of specific materials herein as a necessary, preferred, or optional constituent of a composition according to this invention, so that a material specifically described as necessary, optional, or preferred may be present in a composition according to this invention even if it is a member of some larger class that is unpreferred as noted earlier in this paragraph.

Processes for depositing the lubricant coating include contacting the metal substrate with a lubricant composition according to the invention for a selected time, optionally drying the composition on the metal substrate, and subjecting the metal substrate to a forming operation. Before treatment according to the invention, metal substrate surfaces preferably are conventionally cleaned, pickled, and/or rinsed, in a manner well known in the art for any particular type of substrate.

A coating composition according to the invention is desirably maintained at ambient temperature while coating a metal substrate in a process according to the invention. In particular, the coating composition preferably is at a temperature that is at least, with increasing preference in the order given, 35, 40, 45, 50, 55, 60, 65, 70° F. and independently preferably is not more than, with increasing preference in the order given, 100, 95, 90, 85, 80, or 75° C. Independently, the substrate during a process according to the invention preferably remains in contact with a composition according to the invention for a time that is at least 0.5, 1.0, 1.5, or 2.0 minutes (hereinafter usually abbreviated "min") and independently preferably, at least for economy, is not more than 15, 10, 7, 5, or 3 min.

The metal substrate is then removed from the coating bath and is generally allowed to dry. Drying is preferably accelerated by heating the coated substrate, either by heat generated by cold forming friction or by external heating, for example oven drying. The drying step removes water and other volatiles from the coating and generates a more acidic phosphate at the metal surface which, without being bound by a single theory, is believed to generate the thin passivate coating. In this manner, one drawback of flash rusting upon drying of a metal substrate coated with a prior art aqueous non-reactive lubricant is avoided.

Generally, in order to speed the drying process and to promote some favorable chemical interaction among the non-volatile components of a working composition and the metal substrate, it is preferred to expose the liquid coating formed in a process according to this invention to heat in the course of, or after, drying this liquid coating. The maximum temperature to which the coating is exposed preferably is, with increasing preference in the order given, not less than 30, 40, 50, 60, 70, 80, 90 or 100° C. and independently preferably is, with increasing preference in the order given, not more than 180, 160, 150, 140, 130, or 120° C. Independently, the melting point of the organic polymer in the composition should not be exceeded; for the most preferred examples of component (A), the melting point is about 130° C. The time during which the coating is exposed to the maximum temperature used to dry it preferably is, with increasing preference in the order given, not less than 3, 5, 7, 10, 12, 14, 16, 17, 18, 19, or 20 min and independently preferably is, with increasing preference in the order given, not more than 90, 80, 70, 60, 55, 50, or 45 min.

The specific areal density (also often called "add-on weight [or mass]") of a composition according to this invention, after application from a liquid composition to the metal surface and drying into place on the liquid-coated treated surface of the solid constituents of the liquid coating thus applied, preferably is, with increasing preference in the order given, at least 5.0, 6.0, 7.0 8.0, 9.0, 9.5, 10, 10.5, 11.0, 11.5, 12.0, 12.5, 13.0, 13.4, 13.7, 14.0, or 15.0 grams of dried lubricating composition per square meter of surface (this unit of areal density or add-on weight being hereinafter usually abbreviated as "$g/m^2$") and independently preferably is, with increasing preference in the order given, not more than 50, 45, 40, 35, 30, 25, 20 $g/m^2$. The coating weight of lubricant only can be determined by weighing a coated substrate, removing the lubricant coating from the substrate with the aid of a water solution of detergent and a soft brush, then rinsing, drying, and reweighing to measure the weight of lubricant removed. The weight removed is then converted to coating weight by dividing by the area from which the weighed amount was removed.

Independently and in addition to the coating weight of the lubricant measured as described in the immediately preceding paragraph, in a process according to the invention the substrate coated preferably has a coating weight of phosphate passivating coating that ranges from about 0.001 $mg/m^2$ to about 1000 $mg/m^2$. The phosphate passivating coating weight may be measured with some difficulty due to its low weight, after the lubricant coating has been removed from a test substrate, by stripping the passivate coating in a solution of chromic acid in water as generally known in the art. Generally, evidence of the presence of the passivate coating is seen in the formed parts' resistance to flash rusting.

If the coating weight of either the passivate coating or the lubricant coating is too low, the coating formed will not provide adequate lubrication to prevent galling, seizing, or the like during severe cold working. If the coating weight of either the passivate coating or, especially, the lubricant coating is too high, there will be a substantially increased danger of occurrence of at feast one of two undesirable phenomena known in the art as wash out and lube-burst. In wash out, parts of the exterior surface that have small radii of curvature, for example stamped identifying markings or sharp transitions between two distinct angles of taper, do not retain these features as desired after cold working. In lube-burst, scratches are found on a drawn lubricated surface in a direction at least approximately perpendicular to the direction of drawing, whereas if scratches appear on inadequately lubricated surfaces, the scratches are at least approximately parallel to the direction of drawing.

The practice of this invention may be further appreciated by consideration of the following, non-limiting, working examples, and the benefits of the invention may be further appreciated by reference to the comparison examples.

EXAMPLES

Test Procedure: Cylindrically shaped steel blanks were immersed in a coating solution for a time period of about 1 min. Then, the blanks having the coating solution on their surfaces were dried at a temperature of about 100 degrees C. for about 30 min. The parts were then subjected to cold forming. The performance criteria were die tonnage and part appearance after extrusion.

Example 1

45 parts total, at 3 dilution levels (15 each) of 80%, 90%, and neat were run according to the above test procedure, using a lubricant composition according to the invention as follows as the neat dilution level:

TABLE 1

| Ingredient | Amount in weight % |
|---|---|
| Polyethylene dispersion, 37% solids | 19.0 |
| Monoammonium phosphate | 8.0 |
| Monosodium phosphate, anhydrous | 2.0 |
| Cellulosic thickener | 0.8 |
| Surfactant $C_{9-11}$, 6 moles of ethylene oxide | 0.7 |
| Graphite | 2.0 |
| $MoS_2$ | 1.0 |
| Defoamer | 0.2 |
| Remainder Water | |

Comparative Example 1

Similar parts were subjected to the above test procedure using a coating solution of a commercially available dithiocarbamate containing lubricant described as containing 2-8% (w/v) polyphosphate, 2-5% (w/v) dithiocarbamate, 5-12% (w/v) graphite and 5-12% (w/v) molybdenum disulfide. The forming operation required an average exerted force by the press of 151.5 tons/blank.

The forming operation for the coated parts of Example 1 required an average force/blank as follows; 100%, 147.3 tons, 90%, 147.7 tons, and 80% was 148.5 tons. The lubricant composition of Example 1 allowed processing at an average of 4 tons lower than the commercially available dithiocarbamate containing lubricant. The appearance of the parts after forming in Example 1 was acceptable. They had a similar look to the prior art coated parts, with a mirror finish, and little to no residue present on the surface.

Example 2

Test Procedure: Forty-eight, forged pre-form, carbon steel, vehicle axle blanks were immersed in coating compositions according to the invention: twenty-four blanks for each composition recited in Table 2 for a time period of about 1 min. each. Then, the blanks having the coating solution on their surfaces were dried at a temperature of about 100 degrees C. for about 30 min. The vehicle axle blanks were then subjected to cold forming on a 100-200 ton, hydraulic, Schuler press. The four die transfer press generated an approximately 25% diameter reduction by successively forming the workpiece in each of the four dies. Unlubricated parts were known to stick in these dies. The performance criteria were die tonnage, part appearance after extrusion and residue build-up on the dies.

TABLE 2

| Ingredient (Amount in weight %) | Formula 1 | Formula 2 |
|---|---|---|
| Polyethylene dispersion, 37% solids having a melting point of 130 degrees C. | 19.0 | 19.0 |
| Liquid branched aliphatic hydrocarbon, MW 370 | | 4.1 |
| Monoammonium phosphate | 8.0 | 8.0 |
| Monosodium phosphate, anhydrous | 2.0 | 2.0 |
| Cellulosic thickener | 0.8 | 0.8 |
| Surfactant $C_{9-11}$, 6 moles of ethylene oxide | 0.7 | 0.7 |
| Surfactant $C_{12-15}$, 3 moles of ethylene oxide | | 0.5 |
| Graphite | 2.0 | 2.0 |
| $MoS_2$ | 1.0 | 1.0 |
| Defoamer | 0.2 | 0.2 |
| Remainder Water | | |

Part appearance after coating and drying showed mudcracking and some flake-off of the dry film lubricant formed by Formula 1, a passivate coating with no rust remained on these surfaces. Less mudcracking and flake off was seen in Formula 2 after drying. For the most part, appearance after extrusion was satisfactory and comparable between the two formulas.

Formula 2 showed a die tonnage improvement of about 5% over Formula 1, with less hard residue build-up on the dies and no scratching or galling of the formed part. Hard residue build-up is problematic long term due to possible galling of the formed part as well as die sticking and wearing.

Example 3

Formula 2 of Table 2 was used to cold form 140,000 axles, according to the procedure of Example 2. This number of axles, amounting to 560,000 forming steps was performed without undue bard die residue build-up in the dies. The appearance of the parts after forming was acceptable, with a mirror finish, and little to no residue present on the surface.

What is claimed is:

1. An aqueous liquid lubricant composition comprising:

A) At least one organic polymer and/or a wax dispersion, A) being selected from the group consisting of polyethylene dispersions, polyvinyl alcohols, polyvinylpyrrolidones, acrylic polymers, vinyl acetate polymers, epoxy polymers, urethane polymers, and phenolic polymers;

B) At least one water soluble phosphate salt and/or phosphoric acid, said salt being present in an amount up to solubility limits of the salt;

C) optionally, at least one surfactant;

D) optionally at least one thickening aid;

E) optionally, at least one anti-wear additive;

F) optionally, at least one defoaming agent;

G) optionally, at least one corrosion inhibitor; and

H) optionally, at least one liquid linear or branched hydrocarbon different from A);

wherein the composition has a pH of at least about 3.0 and not more than 6.5, and the weight ratio of (A) to (B) ranges from about 10 to about 0.1.

2. The aqueous liquid lubricant composition of claim 1, wherein

A) comprises 2-15 wt % on a dry solids basis of a polyethylene dispersion,

B) comprises 2-20 wt % of soluble acid phosphate salts;

C) comprises 0.1-1.0 wt % of a surfactant;

D) comprises 0.5-1.0 wt % cellulosic thickener;

E) comprises 0.0-4.0 wt % graphite and/or 0.0-2.0 wt % $MoS_2$;

F) comprises 0.0-1.0 wt % defoamer.

3. The aqueous liquid lubricant composition of claim 1, further comprising (H) 1.0-10.0 wt % of a liquid aliphatic hydrocarbon having a viscosity of 5-1000 cps.

4. The aqueous liquid lubricant composition of claim 1, wherein (B) comprises at least one of monoammonium phosphate and monosodium phosphate.

5. The aqueous liquid lubricant composition of claim 1, comprising a surfactant in an amount effective to promote uniform application of the composition to the substrate.

6. A method of forming a combined passivate and lubricating coating on a metal substrate with which the composition has been brought into contact, the method comprising coating the metal substrate with the composition of claim 1 at ambient temperature and drying the composition on the metal substrate such that a passivate coating forms on the metal substrate during drying.

7. The method of claim 6 further comprising heating the composition at a temperature between about 170 to 250 degrees F. to accelerate the drying of the composition and to promote chemical reaction among non-volatile components and the metal substrate.

8. A metal substrate having a combined passivate and lubricating coating thereon comprising reaction products of the metal substrate and the composition of claim 1.

9. A process of making a formed metal workpiece having a passivate film thereon, comprising:

A) coating a blank metal workpiece with a lubricant composition of claim 1 at 40 to 100 degrees Fahrenheit;

B) drying the lubricant composition on the blank metal workpiece to form a dry film lubricant thereon;

C) forming the blank metal workpiece thereby generating a formed metal workpiece having a passivate film thereon.

10. The process of claim 9, wherein the passivate film is generated either by heating the workpiece after step A) or by the forming step C).

11. An aqueous liquid lubricant working bath composition comprising:

A) At least one organic polymer and/or a wax dispersion, said at least one organic polymer and/or a wax dispersion being free from oxidatively labile groups;

B) At least one soluble inorganic phosphoric acid salt and/or phosphoric acid said salt being present in an amount of at least 4 wt % and up to solubility limits of the salt;

C) optionally, at least one surfactant;

D) optionally at least one thickening aid;

E) optionally, at least one anti-wear additive;

F) optionally, at least one defoaming agent;

G) optionally, at least one corrosion inhibitor; and

H) optionally, at least one liquid linear or branched hydrocarbon different from A);

wherein pH of the composition ranges from at least about 3.0 to not more than 6.5.

12. The aqueous liquid lubricant composition of claim 11, wherein:

A) comprises 2-15 wt % on a dry solids basis of a polyethylene dispersion,

B) comprises 4-20 wt % of soluble phosphoric acid salts;

C) comprises 0.1-1.0 wt % of a surfactant;

D) comprises 0.5-1.0 wt % cellulosic thickener;

E) comprises 0.0-4.0 wt % graphite and/or 0.0-2.0 wt % $MoS_2$;

F) comprises 0.0-1.0 wt % defoamer.

13. The aqueous liquid lubricant composition of claim 11, wherein A) is selected from polyethylene dispersions, polyvinyl alcohols, polyvinylpyrrolidones, acrylic polymers, vinyl acetate polymers, epoxy polymers, urethane polymers, and phenolic polymers.

14. The aqueous liquid lubricant composition of claim 11, wherein the soluble phosphoric acid salts comprise ammonium dihydrogen phosphate and/or an alkali metal dihydrogen phosphate.

15. The aqueous liquid lubricant composition of claim 11, wherein C) comprises:

(1) 0.1-1.0 wt % of a surfactant comprising molecules corresponding to formula I:

$$(C_nH_{2n+1})O(C_2H_4O)_mH \quad (I)$$

where n=9, 10, or 11; and m=4, 5, 6, 7 or 8; and (2) 0.1 to 2.0 wt % of a second surfactant, different from 1).

16. The aqueous liquid lubricant composition of claim 11, wherein the oxidatively labile groups are selected from the group consisting of ketones, aldehydes, carboxyl groups, ether linkages, ester linkages, and non-aromatic unsaturation.

* * * * *